US012012192B1

(12) United States Patent
Powers

(10) Patent No.: US 12,012,192 B1
(45) Date of Patent: Jun. 18, 2024

(54) APERTURED PROPELLER ASSEMBLIES AND METHODS

(71) Applicant: Charles S. Powers, Shreveport, LA (US)

(72) Inventor: Charles S. Powers, Shreveport, LA (US)

( * ) Notice: Subject to any disclaimer, the term of this patent is extended or adjusted under 35 U.S.C. 154(b) by 0 days.

(21) Appl. No.: 18/198,377

(22) Filed: May 17, 2023

(51) Int. Cl.
*B63H 1/20* (2006.01)
*B63H 1/26* (2006.01)
*B63H 5/10* (2006.01)

(52) U.S. Cl.
CPC ..... *B63H 1/20* (2013.01); *B63H 1/26* (2013.01); *B63H 5/10* (2013.01)

(58) Field of Classification Search
CPC ... B63H 1/20; B63H 1/26; B63H 5/10; B63H 23/34; B63H 2023/342
See application file for complete search history.

(56) References Cited

U.S. PATENT DOCUMENTS 123,274 A * 1/1872 McCay ..... F04D 29/34 416/214 R
1,010,929 A * 12/1911 Loetzer ..... F04D 29/34 29/889.6
2,125,549 A * 8/1938 Deal ..... B63H 23/34 416/176
3,002,365 A * 10/1961 Liljequist ..... B63H 1/20 464/30
3,136,400 A * 6/1964 Carr ..... B63H 1/20 416/32
3,246,698 A * 4/1966 Kiekhaefer ..... B63H 20/245 416/189
3,299,964 A * 1/1967 Foster ..... B63H 1/20 416/245 A
3,356,151 A * 12/1967 Strang ..... B63H 20/245 440/89 R
3,563,670 A * 2/1971 Knuth ..... B63H 20/32 416/169 R
3,788,267 A * 1/1974 Strong ..... B63H 1/18 440/89 R
3,790,304 A * 2/1974 Langlois ..... B63H 1/20 416/207
3,876,331 A * 4/1975 DenHerder ..... B63H 1/20 416/214 R (Continued)

FOREIGN PATENT DOCUMENTS

DE 4125436 C1 * 2/1993 ..... B63H 1/20
GB 191001061 A * 10/1910

(Continued)

*Primary Examiner* — John M Zaleskas
(74) *Attorney, Agent, or Firm* — R. Keith Harrison

(57) ABSTRACT

Apertured propeller assemblies may include at least one propeller. The at least one propeller may include a propeller hub having a propeller hub wall. A propeller hub bore may be formed by the propeller hub wall. A plurality of propeller blades may extend from the propeller hub wall. At least one propeller service aperture may extend radially through the propeller hub wall in communication with the propeller hub bore. The at least one propeller service aperture may facilitate dual prop configurations, exhaust flare ring attachments and/or other modifications to the at least one propeller. Other propeller assemblies and apertured propeller methods are also disclosed.

24 Claims, 12 Drawing Sheets

(56) References Cited

U.S. PATENT DOCUMENTS 3,947,151 A * 3/1976 Stillerud ..... B63H 20/245 440/89 R
4,097,191 A * 6/1978 Genuardi ..... B63H 23/34 416/62
4,212,586 A * 7/1980 Aguiar ..... B63H 20/245 416/93 A
4,276,036 A * 6/1981 Nishida ..... F01N 13/12 440/89 R
4,388,070 A * 6/1983 Kasschau ..... F01N 13/12 440/89 R
4,417,852 A * 11/1983 Costabile ..... B63H 1/20 416/134 A
4,511,339 A * 4/1985 Kasschau ..... F01N 13/12 440/89 R
4,545,771 A * 10/1985 Iio ..... B63H 1/28 440/89 R
4,566,855 A * 1/1986 Costabile ..... B63H 1/20 416/169 R
4,619,584 A * 10/1986 Brandt ..... B63H 20/16 416/201 A
4,778,419 A * 10/1988 Bolle ..... B63H 20/245 440/49
4,793,773 A * 12/1988 Kinouchi ..... B63H 5/10 416/169 R
4,802,872 A * 2/1989 Stanton ..... B63H 1/28 440/89 R
4,826,404 A * 5/1989 Zwicky ..... B63H 23/34 416/169 R
4,871,334 A * 10/1989 McCormick ..... F01N 13/12 440/89 R
4,897,058 A * 1/1990 McCormick ..... B63H 5/10 416/129
5,009,621 A * 4/1991 Bankstahl ..... B63H 5/10 416/129
D319,210 S * 8/1991 Koepsel ..... D12/214
5,104,292 A * 4/1992 Koepsel ..... B63H 1/26 416/243
5,180,286 A * 1/1993 Dean ..... B63H 1/20 29/889.6
5,236,310 A * 8/1993 Koepsel ..... B63H 1/26 416/243
5,252,028 A * 10/1993 LoBosco ..... F16F 15/10 416/135
5,423,701 A * 6/1995 Rodskier ..... F01N 13/12 440/89 R
5,522,703 A * 6/1996 Okamoto ..... B63H 23/321 416/93 A
5,549,455 A * 8/1996 Speer ..... B63H 20/245 416/140
5,575,698 A * 11/1996 Ogino ..... B63H 23/30 416/129
5,759,073 A * 6/1998 Sumino ..... B63H 20/245 440/66
5,766,048 A * 6/1998 Iwashita ..... B63H 20/245 440/89 R
5,791,950 A * 8/1998 Weronke ..... F01N 13/12 440/75
5,800,223 A * 9/1998 Iriono ..... F02B 61/045 440/49
5,807,151 A * 9/1998 Sumino ..... B63H 5/10 416/129
5,810,561 A * 9/1998 Cossette ..... B63H 3/12 416/89
5,820,425 A * 10/1998 Ogino ..... B63H 5/10 440/78
5,857,880 A * 1/1999 Harada ..... B63H 21/34 440/89 R
5,902,160 A * 5/1999 Weronke ..... B63H 20/285 440/88 P
5,916,003 A * 6/1999 Masini ..... B63H 1/20 440/89 R
6,010,380 A * 1/2000 Wollard ..... B63H 20/245 440/89 R
6,068,529 A * 5/2000 Weronke ..... F01P 3/202 440/88 P
6,280,144 B1 * 8/2001 Powers ..... B63H 1/26 416/228
6,375,528 B1 * 4/2002 Neisen ..... B63H 20/26 440/89 R
7,086,836 B1 * 8/2006 Sheth ..... B63H 23/34 416/170 R
7,762,772 B1 * 7/2010 Alby ..... B63H 1/20 440/89 A
9,914,515 B1 * 3/2018 Powers ..... B63H 1/28
11,459,074 B1 * 10/2022 Scherer, III ..... B63H 20/32
11,459,078 B1 * 10/2022 Fregonese ..... B63H 21/32
11,713,102 B1 * 8/2023 Scherer, III ..... B63H 20/32 440/89 R
2005/0191180 A1 * 9/2005 Powers ..... B63H 1/20 416/93 A
2005/0226724 A1 * 10/2005 Stahl ..... B63H 5/10 416/93 A
2007/0065282 A1 * 3/2007 Patterson ..... B63H 1/26 416/93 A
2008/0146095 A1 * 6/2008 Fukuoka ..... B63H 20/245 440/89 R
2011/0033296 A1 * 2/2011 Shuto ..... B63H 23/10 416/129
2011/0091328 A1 * 4/2011 Powers ..... B63H 1/26 416/236 R
2014/0248158 A1 * 9/2014 Lin ..... B63H 20/26 416/93 A
2015/0071780 A1 * 3/2015 Oh ..... G01K 13/00 416/129
2015/0098824 A1 * 4/2015 Oh ..... B63H 1/04 416/170 R
2015/0367920 A1 * 12/2015 Ulgen ..... B63H 5/10 416/128
2018/0178890 A1 * 6/2018 Oh ..... B63H 23/02
2019/0127035 A1 * 5/2019 McKinny, Jr. ..... B63H 5/10

FOREIGN PATENT DOCUMENTS

GB 191301957 A * 12/1913
KR 20150133926 A * 12/2015

* cited by examiner

APERTURED PROPELLER ASSEMBLIES AND METHODS

CROSS-REFERENCE TO RELATED APPLICATIONS

This application claims the benefit of U.S. provisional application No. 63/343,175, filed May 18, 2022, and entitled APERTURED PROPELLER ASSEMBLIES AND METHODS, which provisional application is hereby incorporated by reference herein in its entirety.

FIELD

Illustrative embodiments of the disclosure relate to marine propellers. More particularly, illustrative embodiments of the disclosure relate to apertured propeller assemblies and methods in which at least one service aperture may be provided in a propeller hub of at least one propeller to facilitate dual prop configurations, exhaust flare ring attachments and/or other modifications to the propeller.

SUMMARY

Illustrative embodiments of the disclosure are generally directed to apertured propeller assemblies. An illustrative embodiment of the apertured propeller assemblies may include at least one propeller including a propeller hub having a propeller hub wall. A propeller hub bore may be formed by the propeller hub wall. A plurality of propeller blades may extend from the propeller hub wall. At least one propeller service aperture may extend radially through the propeller hub wall in communication with the propeller hub bore. The propeller service aperture may facilitate dual prop configurations, exhaust flare ring attachments and/or other modifications to the propeller.

In some embodiments, the propeller assembly may include a forward propeller including a forward propeller hub with a forward propeller hub wall having a forward propeller hub diameter.

A forward propeller hub bore may be formed by the forward propeller hub wall. A plurality of propeller blades may extend from the propeller hub wall. A rear propeller may include a rear propeller hub with a rear propeller hub wall extending from the forward propeller hub of the forward propeller. The rear propeller hub may have a rear propeller hub diameter less than the forward propeller hub diameter of the forward propeller. A rear propeller hub bore may be formed by the rear propeller hub wall of the rear propeller hub.

Illustrative embodiments of the disclosure are further generally directed to apertured propeller methods. An illustrative embodiment of the apertured propeller methods may include obtaining a propeller assembly having at least one propeller. The propeller may include a propeller hub having a propeller hub wall and a propeller hub bore formed by the propeller hub wall. The method may further include providing at least one radial propeller service aperture in the propeller hub wall of the propeller in communication with the propeller hub bore.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
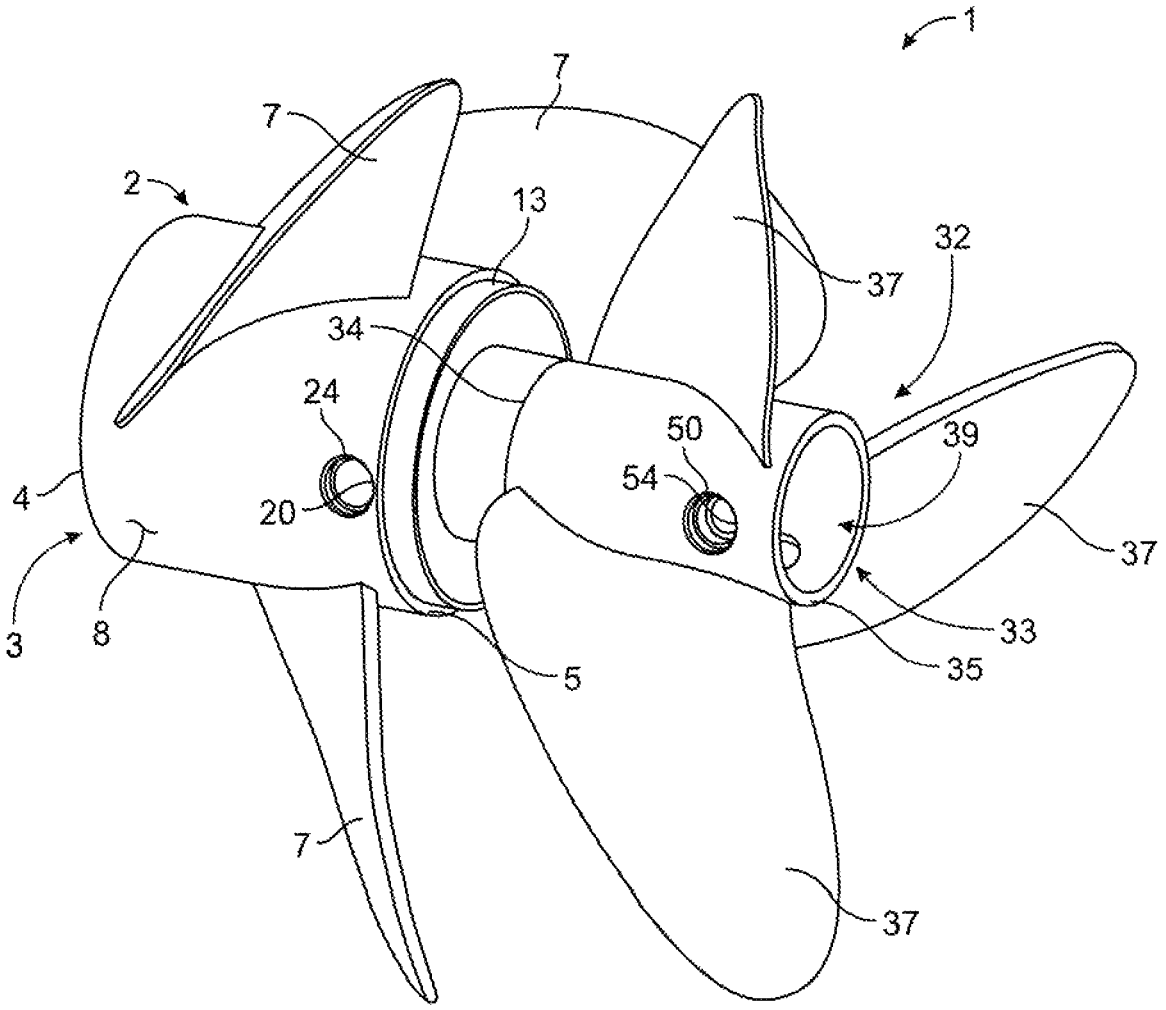
FIG. 1 is a rear perspective view of an illustrative dual prop embodiment of the apertured propeller assemblies of the disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2A:
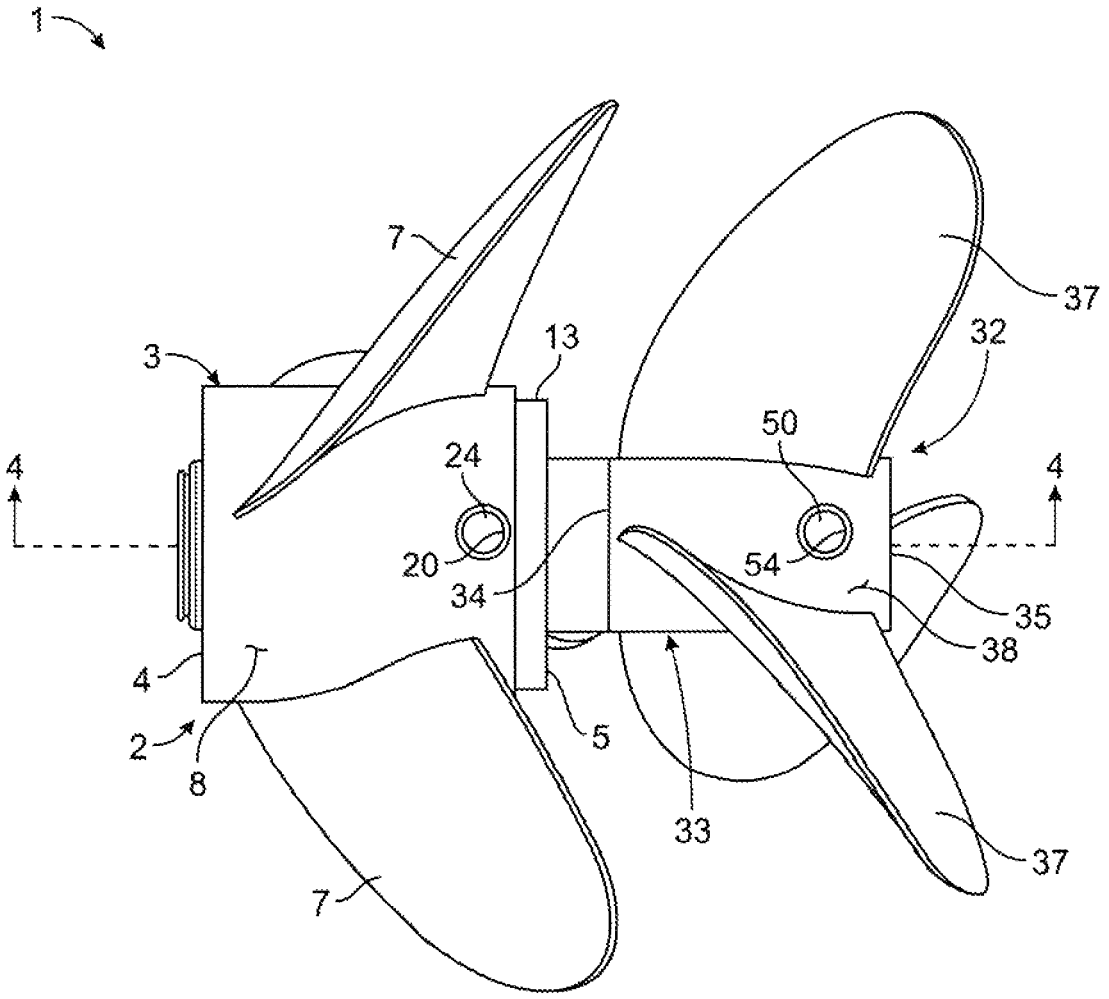
FIG. 2A is a left side view of the illustrative dual prop apertured propeller assembly shown in FIG. 1.
Figure 2B:
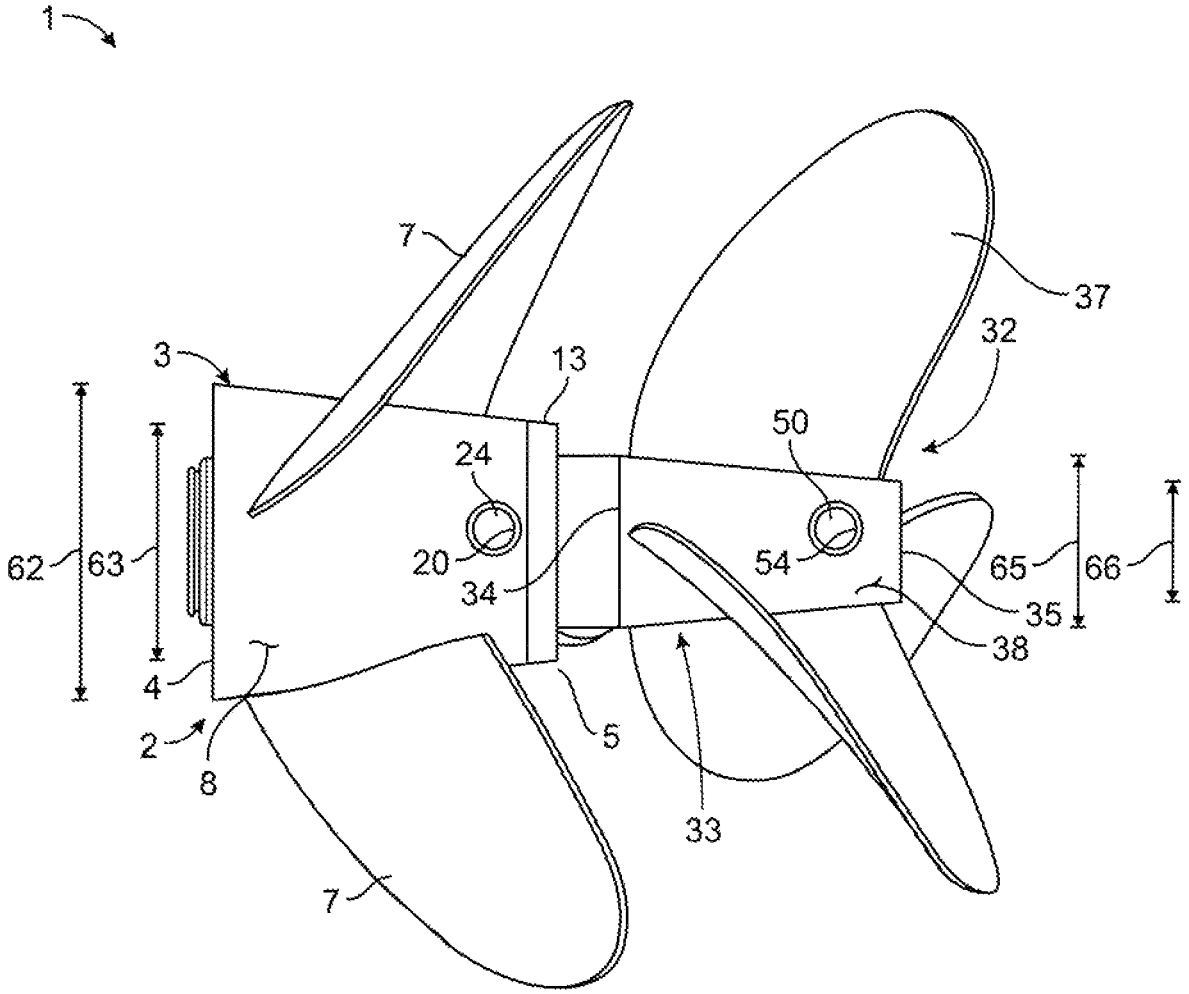
FIG. 2B is a left side view of an illustrative tapered prop embodiment of the dual prop apertured propeller assemblies.
Figure 2C:
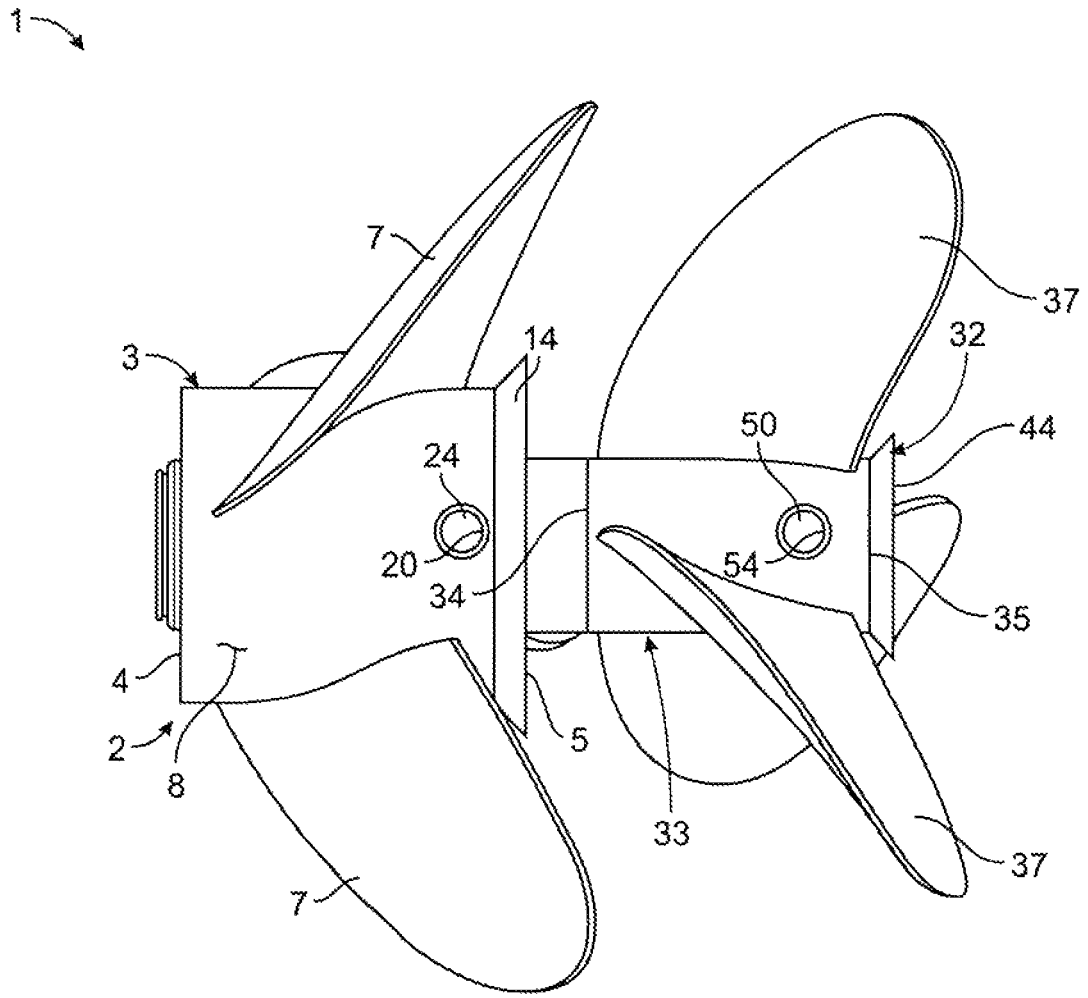
FIG. 2C is a left side view of an illustrative flared prop embodiment of the dual prop apertured propeller assemblies.
Figure 3:
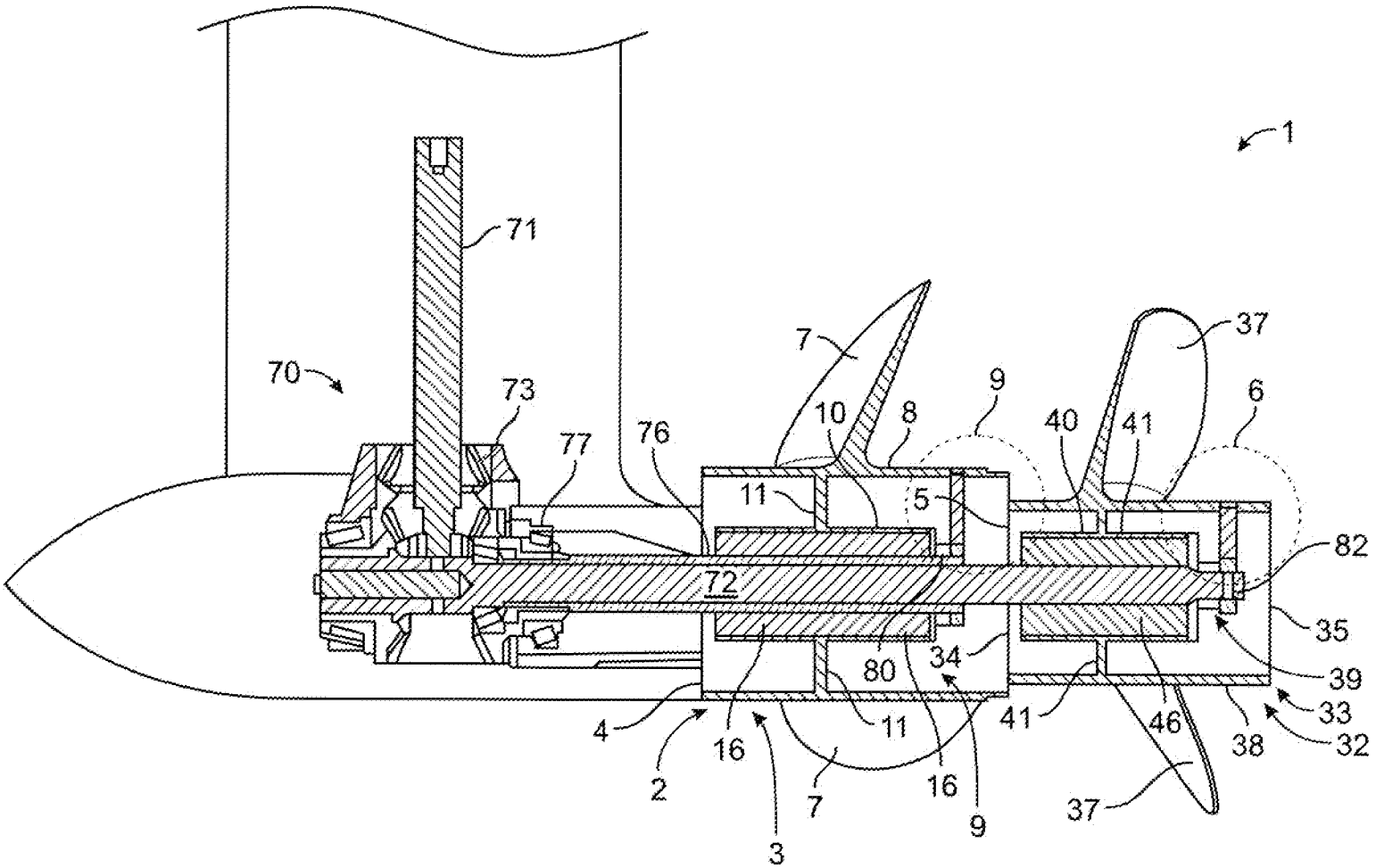
FIG. 3 is a longitudinal sectional view of the illustrative dual prop apertured propeller assembly illustrated in FIG. 1, more particularly illustrating a typical propeller drive assembly which is suitable for drivingly coupling the propeller assembly to a main prop drive shaft on a marine vehicle (not shown)

Referring initially to FIGS. 1-9 of the drawings, an illustrative dual prop embodiment of the apertured propeller assemblies, hereinafter propeller assembly, is generally indicated by reference numeral 1. In typical application, the propeller assembly 1 may be deployed on a marine vehicle (not illustrated) and immersed in a body of water on which the marine vehicle floats to propel the marine vehicle on the water body. As illustrated in FIGS. 1-4, the propeller assembly 1 may include a forward propeller 2 and a rear propeller 32. As illustrated in FIG. 3, the forward propeller 2 may be drivingly engaged by an outer prop drive shaft 76 for rotation in a first clockwise or counterclockwise rotational direction, hereinafter first rotational direction. The rear propeller 32 may be drivingly engaged for rotation in a typically opposite, second clockwise or counterclockwise rotational direction, hereinafter second rotational direction, by an inner prop drive shaft 72 which typically extends through and rotates typically opposite the outer prop drive shaft 76. Accordingly, by rotation of the forward propeller 2 and the rear propeller 32 in the typically opposite first and second rotational directions, the propeller assembly 1 may propel the marine vehicle forwardly or rearwardly on the water body.

Figure 4:
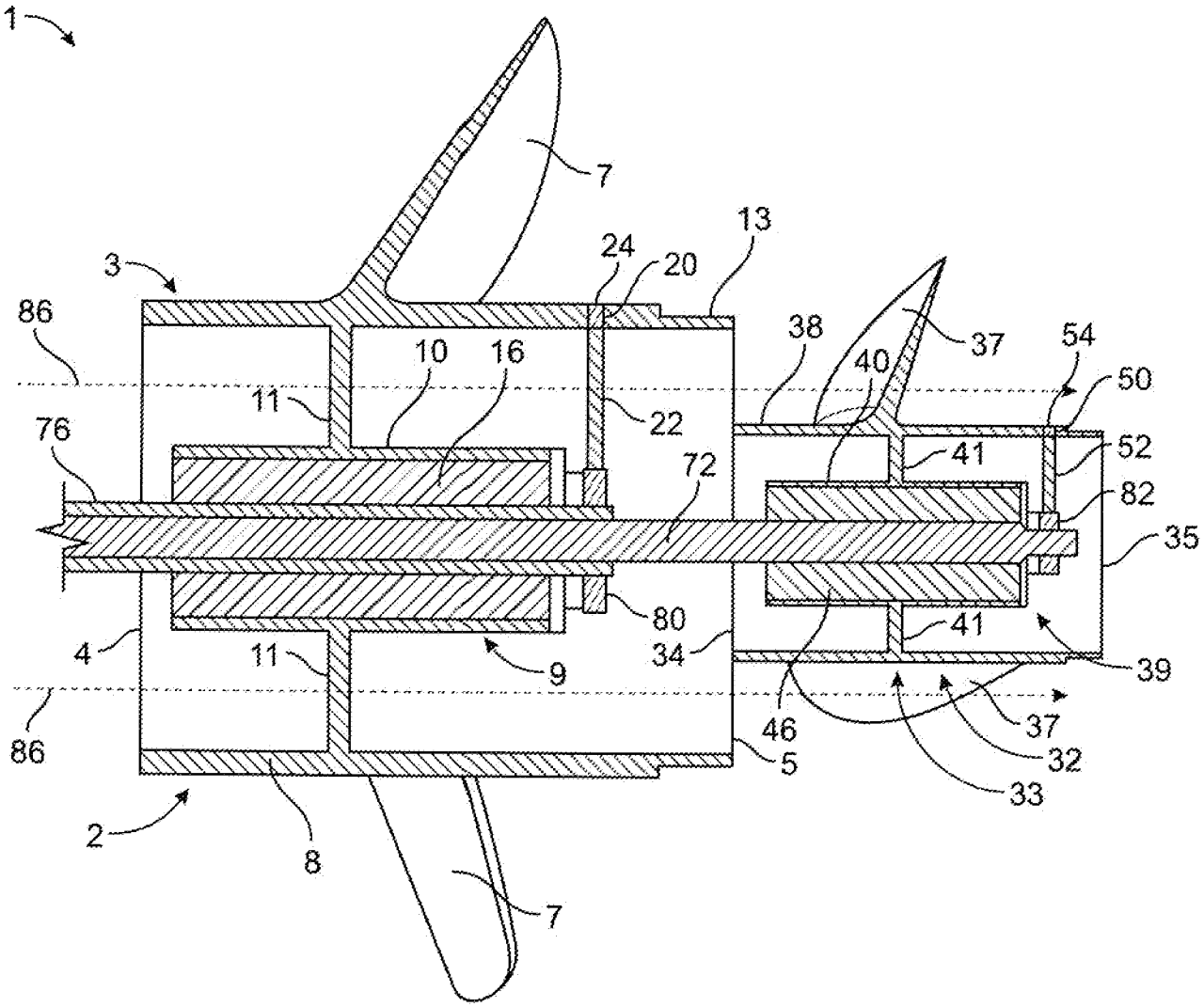
FIG. 4 is an enlarged longitudinal sectional view, taken along section lines 4-4 in FIG. 2A, of the illustrative dual prop apertured propeller assembly illustrated in FIG. 3.

As further illustrated in FIGS. 1-4, the forward propeller 2 of the propeller assembly 1 may have a forward propeller hub 3. The forward propeller hub 3 may have a forward propeller hub wall 8 which may be elongated and generally cylindrical. The forward propeller hub wall 8 may have a fore hub end 4 and an aft hub end 5. As illustrated in FIG. 4, a forward propeller hub bore 9 may be formed by the forward propeller hub wall 8. The forward propeller hub bore 9 may extend through the forward propeller hub 3 from the fore hub end 4 to the aft hub end 5. In some embodiments, an annular forward propeller hub shoulder 13 may be provided in the exterior surface of the forward propeller hub wall 8 at the aft hub end 5, typically for purposes which will be hereinafter described.

Multiple forward propeller blades 7 may extend outwardly from the forward propeller hub wall 8 of the forward propeller hub 3. The forward propeller blades 7 may be oriented to propel the forward propeller 2 forwardly in the body of water as it rotates in the clockwise or counterclockwise first rotational direction and rearwardly in the body of water as it rotates in the typically opposite clockwise or counterclockwise first rotational direction.

As further illustrated in FIG. 4, a forward propeller drive adaptor 16 may be drivingly engaged for rotation, typically via a splined connection, by the outer propeller drive shaft 76. A forward hub drive sleeve 10 may be disposed in the forward propeller hub bore 9 of the forward propeller 2. Forward hub sleeve vanes 11 may mount the forward hub drive sleeve 10 to the forward propeller hub wall 8. The forward hub drive sleeve 10 may be drivingly engaged for rotation, typically via a splined connection, by the forward propeller drive adaptor 16.

Accordingly, rotation of the forward propeller 2 in the first rotational direction may be transmitted from the outer propeller drive shaft 76 to the forward propeller hub 3 and the forward propeller blades 7 of the forward propeller hub 2 via the forward propeller drive adaptor 16, the forward hub drive sleeve 10 and the forward hub sleeve vanes 11, respectively.

A front prop nut 80 may be threaded on the outer propeller drive shaft 76. The front prop nut 80 may secure the forward propeller drive adaptor 16 on the outer prop drive shaft 76, typically in the conventional manner.

At least one forward propeller service aperture 20 may extend radially through the forward propeller hub wall 8 of the forward propeller hub 3, typically proximate the aft hub end 5. The forward propeller service aperture 20 may be cast, milled, drilled and/or otherwise provided in the forward propeller hub wall 8. In some embodiments, the forward propeller service aperture 20 may be disposed forwardly adjacent to the forward propeller hub shoulder 13. Accordingly, in mounting of the forward propeller 2 on the outer propeller drive shaft 76, the forward propeller service aperture 20 may be disposed substantially in alignment or registration with the front prop nut 80.

Figure 9:
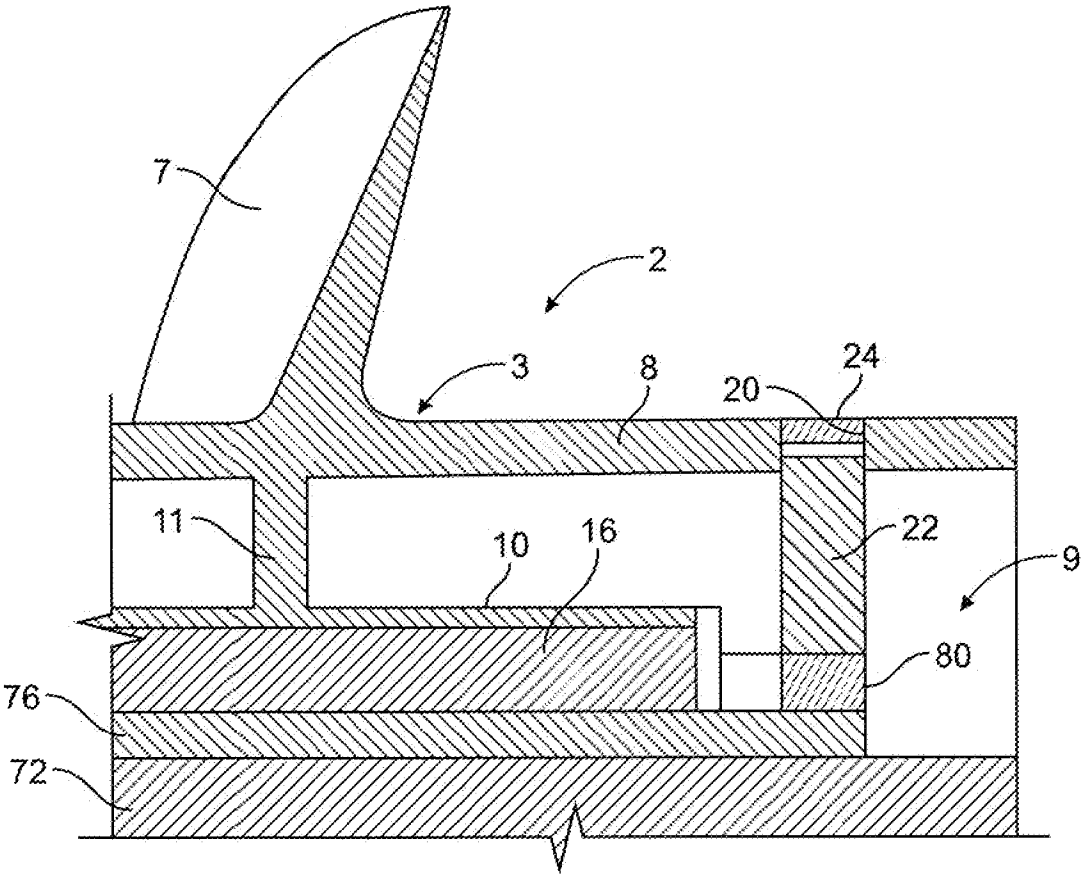
FIG. 9 is an enlarged sectional view, taken along section line 9 in FIG. 3, of an aft portion of the forward propeller of the illustrative dual prop apertured propeller assembly, with a forward propeller service aperture in the hub wall of the forward propeller, a forward propeller aperture plug deployed in the forward propeller service aperture and a forward propeller lock tab engaged by the forward propeller aperture plug and deployed in a propeller nut engaging position.

As illustrated in FIG. 9, in some embodiments, a forward propeller lock tab 22 may be disposed in the forward propeller service aperture 20. The forward propeller lock tab 22 may extend radially into the forward propeller hub bore 9 of the forward propeller hub 3. The forward propeller lock tab 22 may be disposed for selective engagement with the front prop nut 80 to prevent inadvertent loosening of the front prop nut 80 on the outer prop drive shaft 76 during rotation of the propeller assembly 1, typically as will be hereinafter further described.

A forward propeller aperture plug 24 may be removably deployed in the forward propeller service aperture 20. As illustrated in FIG. 4, the deployed forward propeller aperture plug 24 may conceal the forward propeller lock tab 22. Accordingly, the forward propeller aperture plug 24 may be selectively removed from the forward propeller service aperture 20 to expose or facilitate access to the forward propeller lock tab 22. A screwdriver or other tool (not illustrated) may be inserted in the forward propeller service aperture 20 into engagement with the forward propeller lock tab 22 to facilitate pushing or pressing of the forward propeller lock tab 22 into engagement with the front prop nut 80 and prevent inadvertent loosening of the front prop nut 80 on the inner propeller drive shaft 72 during rotation of the propeller assembly 1. When deployed in place in the forward propeller service aperture 20, the forward propeller aperture plug 24 may be substantially flush with the exterior surface of the forward propeller hub wall 8 of the forward propeller hub 3.

In some embodiments, the forward propeller lock tab 22 and the forward propeller aperture plug 24 may threadably engage the forward propeller service aperture 20. Accordingly, exterior tab threads (not illustrated) on the forward propeller lock tab 22 and exterior plug threads (not illustrated) on the forward propeller aperture plug 24 may engage companion interior aperture threads (not illustrated) in the forward propeller service aperture 20. In some embodiments, at least one screwdriver blade slot (not illustrated) may be provided in the forward propeller aperture plug 24. A screwdriver blade on a screwdriver (not illustrated) may be inserted in the screwdriver blade slot to facilitate rotation and axial, linear or radial movement of the forward propeller aperture plug 24 in the forward propeller service aperture 20. In some embodiments, the forward propeller lock tab 22 may removably and threadably engage the forward propeller service aperture 20.

As illustrated in FIG. 4, the rear propeller 32 of the propeller assembly 1 may have a rear propeller hub 33. The rear propeller hub 33 may have a rear propeller hub wall 38 which may be elongated and generally cylindrical. The rear propeller hub wall 38 may have a fore hub end 34 and an aft hub end 35. A rear propeller hub bore 39 may extend through the rear propeller hub 33 from the fore hub end 34 to the aft hub end 35. Multiple rear propeller blades 37 may extend outwardly from the rear propeller hub wall 38 of the rear propeller hub 33.

As further illustrated in FIG. 4, a rear propeller drive adaptor 46 may be drivingly engaged for rotation, typically via a splined connection, by the inner propeller drive shaft 72. A rear hub drive sleeve 40 may be disposed in the rear propeller hub bore 39 of the rear propeller 32. Rear hub sleeve vanes 41 may mount the rear hub drive sleeve 40 to the rear propeller hub wall 38. The rear hub drive sleeve 40 may be drivingly engaged for rotation, typically via a splined connection, by the rear propeller drive adaptor 46. Accordingly, rotation may be transmitted from the inner propeller drive shaft 72 to the rear propeller hub 33 and rear propeller blades 37 of the rear propeller 32 via the rear propeller drive adaptor 46, the rear hub drive sleeve 40 and the rear hub sleeve vanes 41, respectively.

A rear prop nut 82 may be threaded on the inner propeller drive shaft 72. The rear prop nut 82 may secure the rear propeller drive adaptor 46 on the inner prop drive shaft 72, typically in the conventional manner.

Figure 6:
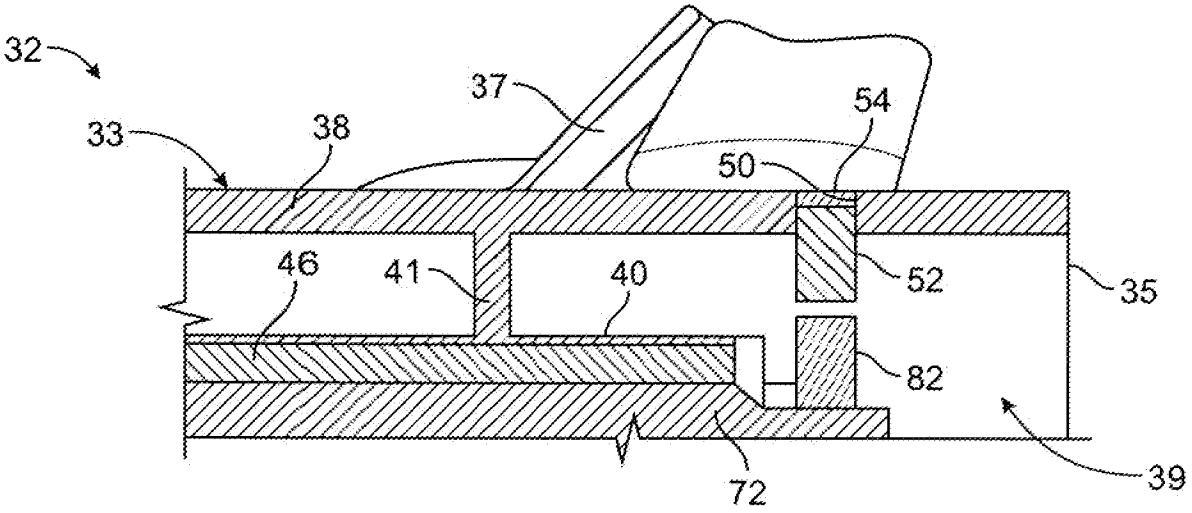
FIG. 6 is an enlarged sectional view, taken along section line 6 in FIG. 3, of an aft portion of the rear propeller of the illustrative dual prop apertured propeller assembly, with a rear propeller service aperture in the hub wall of the rear propeller, a rear propeller aperture plug deployed in the rear propeller service aperture and a rear propeller lock tab engaged by the rear propeller aperture plug and deployed in a propeller nut disengaging position.
Figure 7:
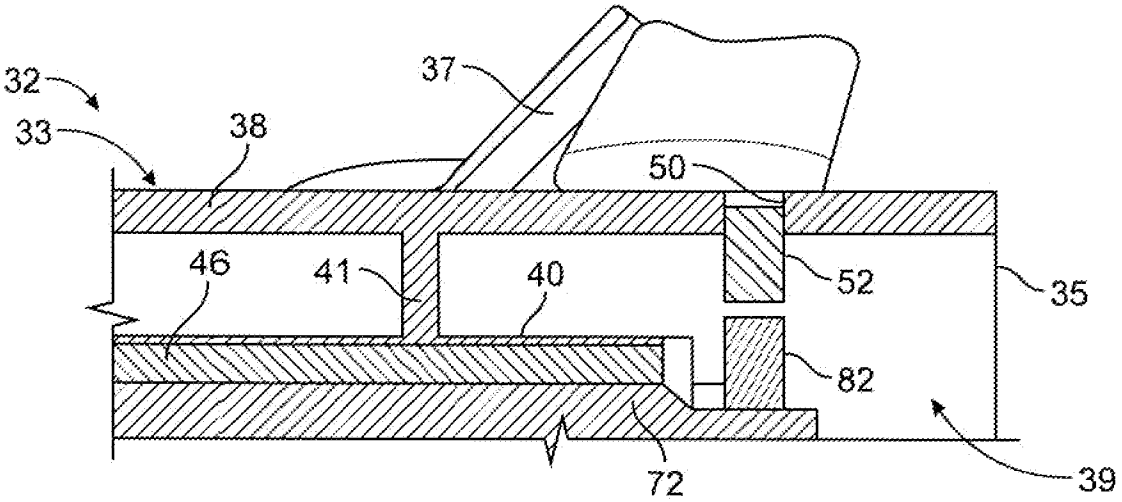
FIG. 7 is an enlarged sectional view, also taken along section line 6 in FIG. 3, with the rear propeller aperture plug removed from the rear propeller service aperture and the rear propeller lock tab disengaging the propeller nut.
Figure 8:
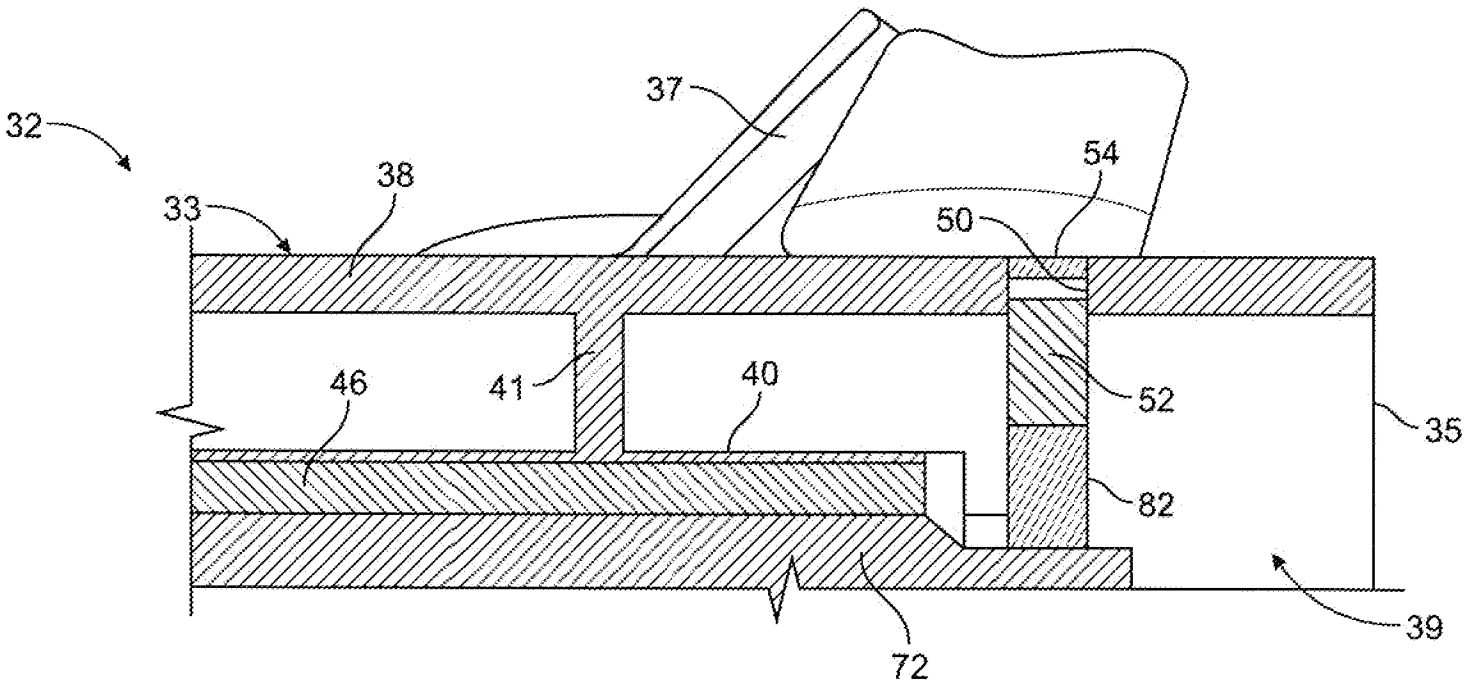
FIG. 8 is an enlarged sectional view, taken along section line 6 in FIG. 3, with the rear propeller aperture plug again deployed in the rear propeller service aperture after the rear propeller lock tab is adjusted to engage the rear propeller nut.

At least one rear propeller service aperture 50 may extend radially through the rear propeller hub wall 38 of the rear propeller hub 33, typically proximate the aft hub end 35. The rear propeller service aperture 50 may be cast, milled, drilled and/or otherwise provided in the rear propeller hub wall 38. The rear propeller service aperture 50 may be disposed forwardly adjacent to the aft hub end 35 of the rear propeller hub 33. Accordingly, in mounting of the rear propeller 22 on the inner propeller drive shaft 72, the rear propeller service aperture 50 may be disposed substantially in alignment or registration with the rear prop nut 82. As illustrated in FIG. 6, a rear propeller lock tab 52 may be disposed in the rear propeller service aperture 50. The rear propeller lock tab 52 may extend into the rear propeller hub bore 39 of the rear propeller hub 33. The rear propeller lock tab 52 may be disposed for selective engagement with the rear prop nut 82 to prevent inadvertent loosening of the rear prop nut 82 on the inner prop drive shaft 72 during rotation of the propeller assembly 1.

A rear propeller aperture plug 54 may be removably deployed in the rear propeller service aperture 50. The deployed rear propeller aperture plug 54 may conceal the rear propeller lock tab 52. Accordingly, the rear propeller aperture plug 54 may be selectively removed from the rear propeller service aperture 50 to expose or facilitate access to the rear propeller lock tab 52. A screwdriver or other tool (not illustrated) may be inserted in the rear propeller service aperture 50 into engagement with the rear propeller lock tab 52 to push or press the rear propeller lock tab 52 into engagement with the rear prop nut 82 and prevent inadvertent loosening of the rear prop nut 82 on the inner propeller drive shaft 72 during rotation of the propeller assembly 1. In some embodiments, at least one screwdriver blade slot (not illustrated) may be provided in the rear propeller aperture plug 54. A screwdriver blade on a screwdriver (not illustrated) may be inserted in the screwdriver blade slot to facilitate rotation and axial, linear or radial movement of the rear propeller aperture plug 54 in the rear propeller service aperture 50. When deployed in place in the rear propeller service aperture 50, the rear propeller aperture plug 54 may be substantially flush with the exterior surface of the rear propeller hub wall 38 of the rear propeller hub 33.

In some embodiments, the rear propeller lock tab 52 and the rear propeller aperture plug 54 may threadably engage the rear propeller service aperture 50. Accordingly, exterior tab threads (not illustrated) on the rear propeller lock tab 52 and exterior plug threads (not illustrated) on the rear propeller aperture plug 54 may engage companion interior aperture threads (not illustrated) in the rear propeller service aperture 50. In some embodiments, the rear propeller lock tab 52 may removably and threadably engage the rear propeller service aperture 50.

The forward propeller service aperture 20 may be located at any point along the length of the forward propeller hub 3 between the fore hub end 4 and the aft hub end 5 of the forward propeller 2. In some embodiments, the forward propeller service aperture 20 may be located at any point or position in the aft half, or 50%, of the forward propeller hub 3. Likewise, the rear propeller service aperture 50 may be located at any point along the length of the rear propeller hub 33 between the fore hub end 34 and the aft hub end 35 of the rear propeller 32. In some embodiments, the rear propeller service aperture 50 may be located at any point or position in the aft half, or 50%, of the rear propeller hub 33.

In various embodiments, the forward propeller service aperture 20 of the forward propeller 2 and the rear propeller service aperture 50 of the rear propeller 32 may include a slot, rectangle, helix segment, round hole or other geometric shape. The forward propeller aperture plug 24 and the rear propeller aperture plug 54 may include plastic, metal, rubber, composite and/or other material or combination of materials which facilitate(s) non-turbulent flow of water around the corresponding aperture.

Figure 5:
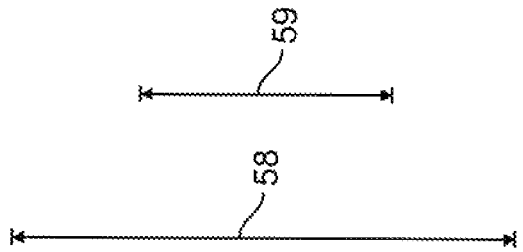
FIG. 5 is a diagram illustrating a typical diameter difference between a forward propeller hub outer diameter and a rear propeller hub outer diameter of a forward propeller and a rear propeller, respectively, of the dual prop apertured propeller assembly.

As illustrated in FIGS. 4 and 5, the aft hub end 5 of the forward propeller 2 may have a forward prop hub outer diameter (OD) 58 which is larger than a rear prop hub outer diameter (OD) 59 at the fore hub end 34 of the rear propeller 32. In some embodiments, the rear prop hub diameter 59 of the rear propeller 32 may be about 20%-50% less than the forward prop hub diameter 58 of the forward propeller 2. Typically, the rear prop hub diameter 59 of the rear propeller 32 may be about 50% less than the forward prop hub diameter 58 of the forward propeller 2.

An illustrative tapered prop embodiment of the dual prop apertured propeller assemblies 1 is illustrated in FIG. 2B. Accordingly, one or both of the forward propeller hub 3 of the forward propeller 2 and the rear propeller hub 33 of the rear propeller 32 may be tapered in the fore to aft direction. The same description which was set forth herein above with respect to the dual propeller assembly 1 in FIG. 2A may be applicable to the flared prop embodiment of the dual prop apertured propeller assemblies 1 in FIG. 2B and is incorporated by reference herein in its entirety. The fore hub end 4 and the aft hub end 5 of the forward propeller hub 3 may have a forward hub fore end diameter 62 and a forward hub aft end diameter 63, respectively. The fore hub end 34 and the aft hub end 35 of the rear propeller hub 33 may have a rear hub fore end diameter 65 and a rear hub aft end diameter 66, respectively. In some embodiments, the forward hub fore end diameter 62 may be greater than the forward hub aft end diameter 63 of the forward propeller hub 3. Additionally or alternatively, the rear hub fore end diameter 65 may be greater than the rear hub aft end diameter 66 of the rear propeller 32. In some embodiments, the average difference in diameter from the fore hub end 4 to the aft hub end 5 of the tapered forward propeller hub 3 of the forward propeller 2, or the diameter difference between the forward hub fore end diameter 62 and the forward hub aft end diameter 63, may be 50%. Likewise, the average difference in diameter from the fore hub end 34 to the aft hub end 35 of the tapered rear propeller hub 33 of the rear propeller 32, or the diameter difference between the rear hub fore end diameter 65 and the rear hub aft end diameter 66, may be 50%.

An illustrative flared prop embodiment of the dual prop apertured propeller assemblies 1 is illustrated in FIG. 2C. Accordingly, a forward prop hub flare 14 may extend outwardly from the aft hub end 5 of the forward propeller hub 3. Additionally or alternatively, a rear prop hub flare 44 may extend outwardly from the aft hub end 35 of the rear propeller hub 33. The same description which was set forth herein above with respect to the dual propeller assembly 1 in FIG. 2A may be applicable to the flared prop embodiment of the dual prop apertured propeller assemblies 1 in FIG. 2C and is incorporated by reference herein in its entirety. In some embodiments, the tapered prop embodiment of the dual prop apertured propeller assembly 1 which was heretofore described with respect to FIG. 2B may include the forward prop hub flare 14 on the forward propeller hub 3 and/or the rear prop hub flare 44 on the rear propeller hub 33.

As illustrated in FIG. 3, a typical propeller drive assembly 70 which is suitable for rotating the forward propeller 2 and the rear propeller 32 of the propeller assembly 1 is shown. The propeller drive assembly 70 may include a main propeller drive shaft 71. The main propeller drive shaft 71 may be drivingly engaged for rotation by a motor (not illustrated) on the marine vehicle, typically in the conventional manner. An outer shaft drive gear 77 may be drivingly engaged for rotation by the main propeller drive shaft 71. The outer propeller drive shaft 76 may be drivingly engaged for rotation by the outer shaft drive gear 77. Accordingly, responsive to operation of the motor of the marine vehicle, the main propeller drive shaft 71 may rotate the forward propeller 2 in the first rotational direction through the outer shaft drive gear 77, the outer propeller drive shaft 76, the forward propeller drive adaptor 16, the forward hub drive sleeve 10 and the forward hub sleeve vanes 11, respectively.

As further illustrated in FIG. 3, the inner propeller drive shaft 72 may extend through and terminate beyond the distal or extending end of the outer propeller drive shaft 76. An inner shaft drive gear 73 may be drivingly engaged for rotation by the main propeller drive shaft 71. The inner propeller drive shaft 72 may be drivingly engaged for rotation by the inner shaft drive gear 73 in the second rotational direction as the outer propeller drive shaft 76 is rotated in the second rotational direction. Accordingly, responsive to operation of the motor of the marine vehicle, the main propeller drive shaft 71 may rotate the rear propeller 32 in the second rotational direction through the inner shaft drive gear 73, the inner propeller drive shaft 72, the rear propeller drive adaptor 46, the rear hub drive sleeve 40 and the rear hub sleeve vanes 41, respectively. It will be recognized and understood by those skilled in the art that a variety of alternative propeller drive assemblies 70 having various components and configurations are possible for simultaneously rotating the outer propeller drive shaft 76 and the inner propeller drive shaft 72 in the respective typically opposite first and second rotational directions. For example and without limitation, a propeller drive assembly 70 which may be suitable for the purpose is described in U.S. Pat. No. 10,106,236, which is hereby incorporated by reference herein in its entirety.

In typical application, the dual prop propeller assembly 1 may be assembled on the marine vehicle (not illustrated) to propel the marine vehicle on a body of water. Accordingly, the forward propeller 2 and the rear propeller 32 of the propeller assembly 1 may be disposed in driving engagement with the outer propeller drive shaft 76 and the inner propeller drive shaft 72, respectively. The propeller assembly 1 may be immersed in the body of water as the marine vehicle is placed thereon. Responsive to operation of the motor (not illustrated) of the marine vehicle, the main propeller drive shaft 71 of the propeller drive assembly 70 may simultaneously rotate the outer propeller drive shaft 76 and the inner propeller drive shaft 72 in the respective first and second rotational directions. The front propeller 2 and the rear propeller 32 may responsively rotate in the respective corresponding first and second rotational directions as the forward propeller blades 7 on the forward propeller 2 and the rear propeller blades 37 on the rear propeller 32 propel the propeller assembly 1 and the marine vehicle on the water. As illustrated in FIG. 4, motor exhaust 86 from the motor of the marine vehicle may be routed into the body of water through the forward propeller hub bore 9 of the forward propeller 2 and over the exterior of the rear propeller hub 33 of the rear propeller 32.

It will be appreciated by those skilled in the art that the dual prop embodiment of the propeller assembly 1 may eliminate or substantially minimize steering torque to the marine vehicle since the rotational forces of the forward propeller 2 and the rear propeller 32 largely offset each other. The propeller assembly 1 may provide several advantages over standard or conventional dual prop designs. For example, in conventional dual props in which the forward propeller and the rear propeller have the same diameters, the extended running surface of the propeller hubs may tend to create a pronounced ski effect, causing the marine vehicle to run stem high. On marine vehicles which require a bow high running attitude, this extended running surface may lead to handling and performance issues. Moreover, the conventional method of routing the motor exhaust over the forward and rear propellers of like diameter tends not to restrain the exhaust, but rather, routes the exhaust onto the blade surfaces, thus tending to produce ventilation, especially in initial planing and high-speed cornering maneuvers of the marine vehicle. The dual prop propeller assembly 1 may utilize a through hub exhaust forward propeller 2 having the relatively large forward propeller hub diameter 58 (FIG. 5), coupled with an overhub exhaust rear propeller 32 having the relatively smaller rear propeller hub diameter 59, as was heretofore described with respect to FIG. 4. This reduction of running surface from the relatively large forward propeller hub diameter 58 to the relatively smaller rear propeller hub diameter 59 may allow the stem of the marine vehicle to settle appreciably, improving bow lift and hull efficiencies on marine vehicles having hulls with this type of hydrodynamic design. Notably, since it may be a full-size propeller, the forward propeller 2 may bite into clean water, thereby producing a significant increase in holeshot or planing and improvement in handling and high-speed cornering when compared to the conventional two over-hub exhaust props.

In some applications, the forward propeller service aperture 20 of the forward propeller 2 and/or the rear propeller service aperture 50 of the rear propeller 32 may facilitate other modifications to the propeller assembly 1. For example and without limitation, the forward propeller service aperture 20 may allow for the use of fixed or removable exhaust flare or other shaped rings (not illustrated) on the departing surface typically at the forward propeller hub shoulder 13 at the departing surface of the forward propeller 2 to create a pressure wave that helps to prevent exhaust gas migration from the over hub exhaust rear propeller 32 into the forward propeller blades 7 of the forward propeller 2. This may be accomplished by, for example and without limitation, extending and securing a fastener (not illustrated) through a fastener opening in the exhaust flare ring and the registering forward propeller service aperture 20. This expedient may help reduce ventilation in planing and cornering maneuvers. The attachments on the forward propeller 2 may also help change the running attitude of the marine vehicle, as a flare tends to impart a more stem-high attitude to the vehicle, whereas a milled slot may tend to impart a pressure wave with a lower stem attitude to the vehicle. These adjustments may facilitate fine-tuning of the running attitude of a marine vehicle.

Figure 10:
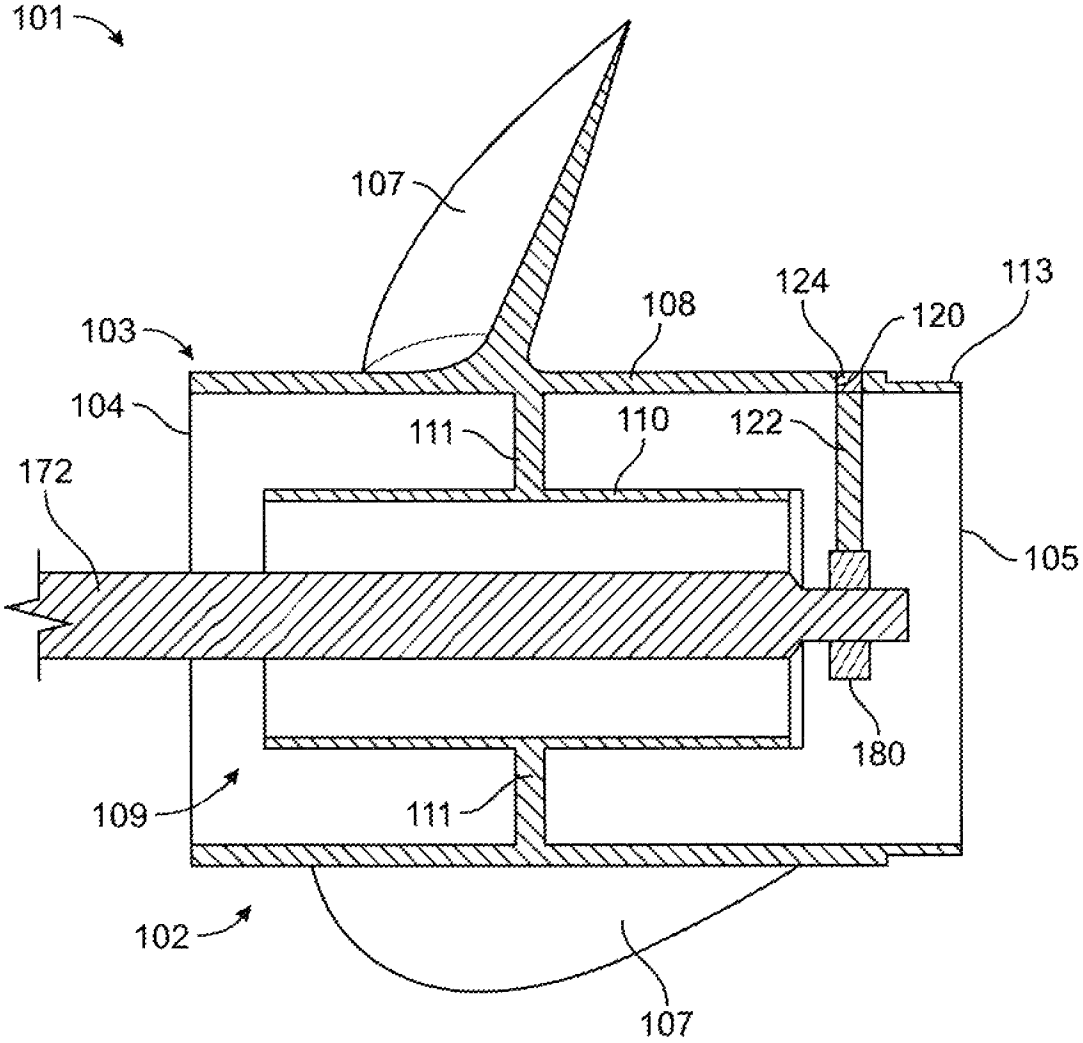
FIG. 10 is a longitudinal sectional view of an illustrative single prop embodiment of the apertured propeller assemblies of the disclosure.

Referring next to FIG. 10 of the drawings, an illustrative single prop embodiment of the propeller assemblies is generally indicated by reference numeral 101. In the single prop propeller assembly 101, elements which are analogous to the respective elements of the dual prop propeller assembly 1 that was heretofore described with respect to FIGS. 1-9 are designated by the same respective numerals in the 101-199 series in FIG. 10. Accordingly, to the extent which is applicable, the same description which was heretofore described with respect to the propeller assembly 1 is incorporated by reference herein in its entirely herein with respect to the propeller assembly 101. The propeller assembly 101 may include a propeller aperture plug 124 which extends radially through the propeller hub wall 108, typically adjacently forwardly of the propeller hub shoulder 113 in the exterior surface at the aft hub end 105 of the propeller hub 103.

A propeller lock tab 122 may be disposed in the propeller service aperture 120. The propeller lock tab 122 may extend into the propeller hub bore 109 of the propeller hub 103. The propeller lock tab 122 may be disposed for selective engagement with the prop nut 180 to prevent inadvertent loosening of the prop nut 180 on the prop drive shaft 172 during rotation of the propeller assembly 101.

A propeller aperture plug 124 may be removably disposed in the propeller service aperture 120 to normally conceal the forward propeller lock tab 122. Accordingly, the propeller aperture plug 124 may be selectively removed from the propeller service aperture 120 to expose or facilitate access to the propeller lock tab 122. A screwdriver or other tool (not illustrated) may be inserted in the propeller service aperture 120 into engagement with the propeller lock tab 122 to facilitate pushing or pressing of the propeller lock tab 122 into engagement with the prop nut 180 and prevent inadvertent loosening of the prop nut 180 on the propeller drive shaft 172 during rotation of the propeller assembly 101.

In some embodiments, the propeller lock tab 122 may threadably engage the propeller service aperture 120. Accordingly, exterior tab threads (not illustrated) on the propeller lock tab 122 and exterior plug threads (not illustrated) on the propeller aperture plug 124 may engage companion interior aperture threads (not illustrated) in the propeller service aperture 120. In some embodiments, at least one screwdriver blade slot (not illustrated) may be provided in the propeller aperture plug 124. A screwdriver blade on a screwdriver (not illustrated) may be inserted in the screwdriver blade slot to facilitate rotation and axial, linear or radial movement of the propeller aperture plug 124 in the propeller service aperture 120.

Application of the single prop propeller assembly 101 may be as was heretofore described with respect to the dual prop propeller assembly 1 in FIGS. 1-9. Accordingly, the propeller lock tab 122 may be pushed, pressed or threaded into engagement with the prop nut 180 to prevent the prop nut 180 from inadvertently loosening on the propeller drive shaft 172 during operation of the marine vehicle. In some applications, other modifications, such as installation of flare or other shaped rings, for example and without limitation, may be made to the propeller assembly 101 using the propeller service aperture 120.

Figure 11:
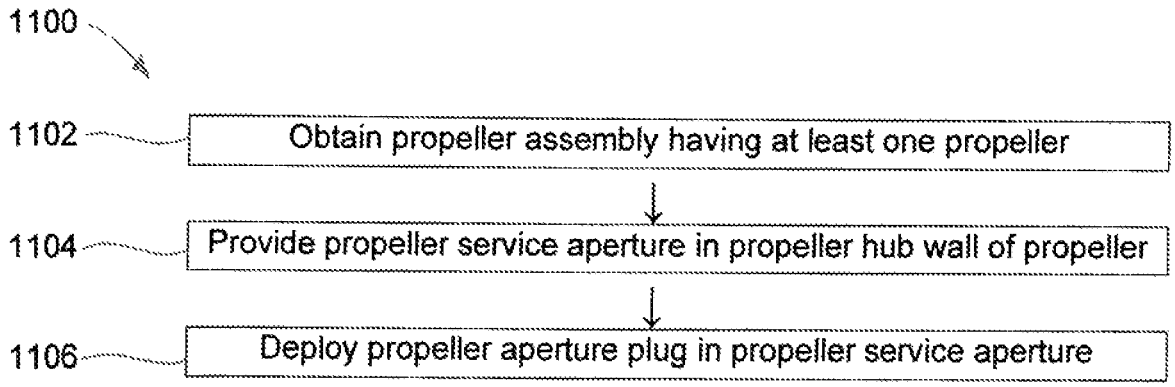
FIG. 11 is a flow diagram of an illustrative embodiment of the apertured propeller methods of the disclosure.

Referring next to FIG. 11 of the drawings, a flow diagram 1100 of an illustrative embodiment of the apertured propeller methods of the disclosure is shown. At Step 1102, a propeller assembly having at least one propeller may be obtained. In some embodiments, the propeller assembly may be a single prop propeller assembly having a single propeller. In other embodiments, the propeller assembly may be a dual prop propeller assembly having a forward propeller and a rear propeller. Each propeller may include a propeller hub wall and a propeller hub bore formed by the propeller hub wall.

At Step 1104, at least one radial propeller service aperture may be provided in the propeller hub wall of the propeller. The propeller service aperture may be cast, milled, drilled or otherwise provided in the propeller hub wall.

At Step 1106, a propeller aperture plug may be deployed in the propeller service aperture.

Figure 12:
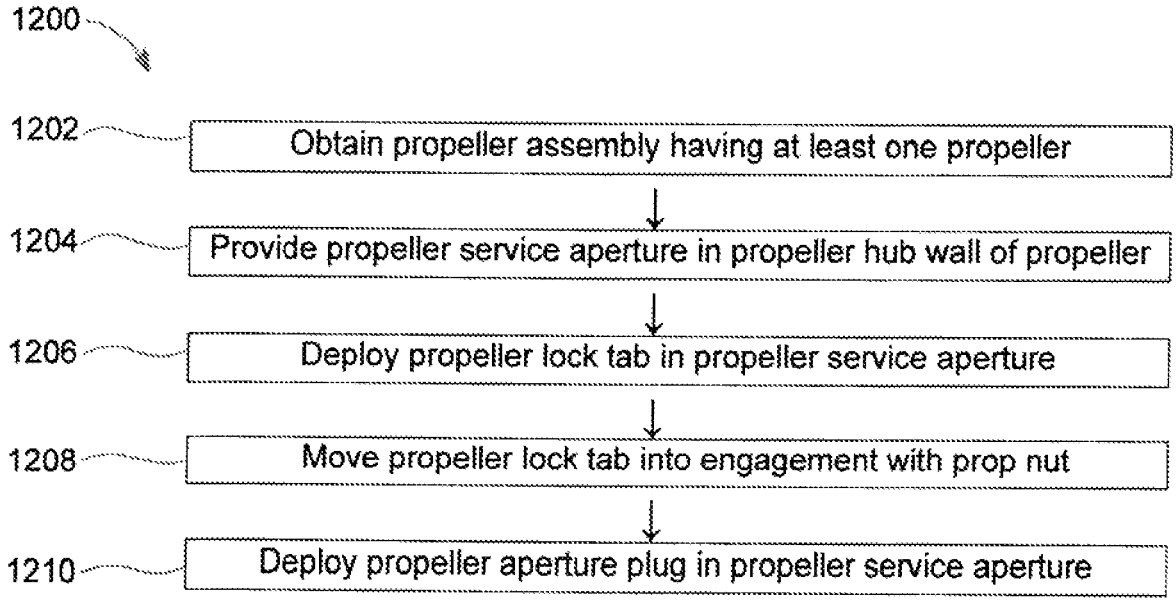
FIG. 12 is a flow diagram of another illustrative embodiment of the apertured propeller methods of the disclosure.

Referring next to FIG. 12 of the drawings, a flow diagram 1200 of another illustrative embodiment of the apertured propeller methods of the disclosure is shown. At Step 1202, a propeller assembly having at least one propeller may be obtained. In some embodiments, the propeller assembly may be a single prop propeller assembly having a single propeller. In other embodiments, the propeller assembly may be a dual prop propeller assembly having a forward propeller and a rear propeller. Each propeller may include a propeller hub wall and a propeller hub bore formed by the propeller hub wall.

At Step 1204, at least one radial propeller service aperture may be provided in the propeller hub wall of the propeller. The propeller service aperture may be cast, milled, drilled or otherwise provided in the propeller hub wall.

At Step 1206, a propeller lock tab may be deployed in the propeller service aperture.

At Step 1208, the propeller lock tab may be pushed, pressed, threaded or otherwise moved into engagement with a prop nut.

At Step 1210, a propeller aperture plug may be deployed in the propeller service aperture.

Figure 13:
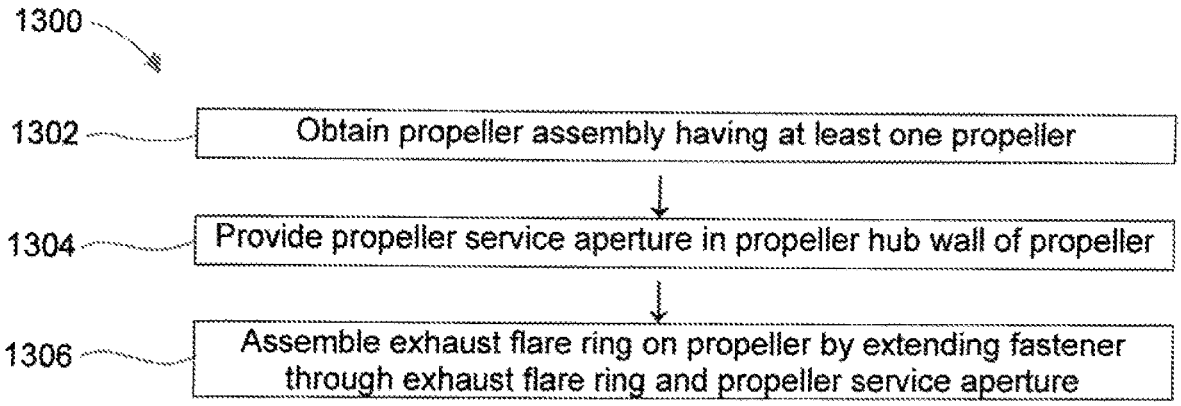
FIG. 13 is a flow diagram of still another illustrative embodiment of the apertured propeller methods of the disclosure.

Referring next to FIG. 13 of the drawings, a flow diagram 1300 of still another illustrative embodiment of the apertured propeller methods of the disclosure is shown. At Step 1302, a propeller assembly having at least one propeller may be obtained. In some embodiments, the propeller assembly may be a single prop propeller assembly having a single propeller. In other embodiments, the propeller assembly may be a dual prop propeller assembly having a forward propeller and a rear propeller.

At Step 1304, at least one propeller service aperture may be provided in the propeller hub wall of the propeller. The propeller service aperture may be cast, milled, drilled or otherwise provided in the propeller hub wall.

At Step 1306, an exhaust flare ring or other type of ring may be assembled on the propeller. In some applications, this may be accomplished by, for example and without limitation, extending and securing a fastener through a fastener opening in the exhaust flare ring and the propeller service aperture.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A propeller assembly configured for driving engagement by a propeller drive assembly having at least one propeller drive shaft and at least one prop nut configured to secure the propeller assembly on the at least one propeller drive shaft, the propeller assembly comprising:

at least one propeller including:

a propeller hub having a propeller hub wall;

a propeller hub bore formed by the propeller hub wall;

a propeller drive adaptor in the propeller hub bore, the propeller drive adaptor configured for driving engagement for rotation by the at least one propeller drive shaft;

a hub drive sleeve in the propeller hub bore and drivingly engaged for rotation by the propeller drive adaptor, the hub drive sleeve drivingly engaging the propeller hub for rotation, the at least one prop nut threaded on the at least one propeller drive shaft and configured to secure the propeller drive adaptor on the at least one propeller drive shaft; and a plurality of propeller blades extending from the propeller hub wall;

at least one propeller service aperture extending radially through the propeller hub wall in communication with the propeller hub bore, the at least one propeller service aperture configured for substantial radial alignment or registration with the at least one prop nut in driving engagement between the propeller drive assembly and the propeller assembly; and a propeller lock tab disposed in the at least one propeller service aperture, the propeller lock tab configured for selective radial positional adjustment within the at least one propeller service aperture and the propeller hub bore for radial engagement and disengagement of the propeller lock tab with respect to the at least one prop nut.

2. The propeller assembly of claim 1 comprising a propeller aperture plug removably deployed in the at least one propeller service aperture.

3. The propeller assembly of claim 1 wherein the propeller hub wall of the propeller hub is tapered.

4. The propeller assembly of claim 3 wherein the propeller hub wall of the propeller hub has a fore hub end with a hub fore end diameter and an aft hub end with a hub aft end diameter, and a difference in diameter between the hub fore end diameter and the hub aft end diameter is 50%.

5. The propeller assembly of claim 1 comprising a prop hub flare extending outwardly from the propeller hub wall of the propeller hub.

6. The propeller assembly of claim 1 wherein the at least one propeller comprises a forward propeller having a forward propeller hub and a rear propeller having a rear propeller hub disposed aft of the forward propeller hub of the forward propeller.

7. The propeller assembly of claim 6 wherein the forward propeller hub of the forward propeller has a forward prop hub outer diameter, and the rear propeller hub of the rear propeller has a rear prop hub outer diameter less than the forward prop hub outer diameter of the forward propeller hub of the forward propeller.

8. The propeller assembly of claim 7 wherein the rear prop hub outer diameter of the rear propeller is 20%-50% less than the forward prop hub outer diameter of the forward propeller.

9. The propeller assembly of claim 8 wherein the rear prop hub outer diameter of the rear propeller is 50% less than the forward prop hub outer diameter of the forward propeller.

10. The propeller assembly of claim 1 wherein the propeller hub wall of the propeller hub has a fore hub end and an aft hub end, and the at least one propeller service aperture is located at a selected point or position in an aft 50% along the length of the propeller hub.

11. The propeller assembly of claim 1 further comprising a propeller aperture plug removably deployed in the at least one propeller service aperture to conceal the propeller lock tab in the at least one propeller service aperture.

12. A propeller assembly configured for driving engagement by a propeller drive assembly having an inner propeller drive shaft, an outer propeller drive shaft, a rear prop nut configured to secure the propeller assembly on the inner propeller drive shaft and a front prop nut configured to secure the propeller assembly on the outer propeller drive shaft, the propeller assembly comprising:

a forward propeller including:

a forward propeller hub including a forward propeller hub wall having a forward prop hub outer diameter;

a forward propeller hub bore formed by the forward propeller hub wall;

a forward propeller drive adaptor in the forward propeller hub bore, the forward propeller drive adaptor configured for driving engagement for rotation by the outer propeller drive shaft;

a forward hub drive sleeve in the forward propeller hub bore and drivingly engaged for rotation by the forward propeller drive adaptor, the forward hub drive sleeve drivingly engaging the forward propeller hub for rotation, the front prop nut threaded on the outer propeller drive shaft and configured to secure the forward propeller drive adaptor on the outer propeller drive shaft; and a plurality of forward propeller blades extending from the forward propeller hub wall;

at least one forward propeller service aperture extending radially through the forward propeller hub wall in communication with the forward propeller hub bore of the forward propeller, the at least one forward propeller service aperture configured for substantial radial alignment or registration with the front prop nut in driving engagement between the propeller drive assembly and the propeller assembly;

a forward propeller lock tab disposed in the at least one forward propeller service aperture of the forward propeller, the forward propeller lock tab configured for selective radial positional adjustment within the at least one forward propeller service aperture and the forward propeller hub bore for radial engagement and disengagement of the forward propeller lock tab with respect to the front prop nut;

a rear propeller including:

a rear propeller hub including a rear propeller hub wall having a rear prop hub outer diameter;

a rear propeller hub bore formed by the rear propeller hub wall;

a rear propeller drive adaptor in the rear propeller hub bore, the rear propeller drive adaptor configured for driving engagement for rotation by the inner propeller drive shaft;

a rear hub drive sleeve in the rear propeller hub bore and drivingly engaged for rotation by the rear propeller drive adaptor, the rear hub drive sleeve drivingly engaging the rear propeller hub for rotation, the rear prop nut threaded on the inner propeller drive shaft and configured to secure the rear propeller drive adaptor on the inner propeller drive shaft; and a plurality of rear propeller blades extending from the rear propeller hub wall; and at least one rear propeller service aperture extending radially through the rear propeller hub wall in communication with the rear propeller hub bore of the rear propeller, the at least one rear propeller service aperture configured for substantial radial alignment or registration with the rear prop nut in driving engagement between the propeller drive assembly and the propeller assembly;

a rear propeller lock tab disposed in the at least one rear propeller service aperture of the rear propeller, the rear propeller lock tab configured for selective radial positional adjustment within the at least one rear propeller service aperture and the rear propeller hub bore for radial engagement and disengagement of the rear propeller lock tab with respect to the rear prop nut; and wherein the rear prop hub outer diameter of the rear propeller is less than the forward prop hub outer diameter of the forward propeller.

13. The propeller assembly of claim 12 comprising a forward propeller aperture plug removably deployed in the at least one forward propeller service aperture and a rear propeller aperture plug removably deployed in the at least one rear propeller service aperture.

14. The propeller assembly of claim 12 wherein each of the forward propeller hub wall of the forward propeller hub and the rear propeller hub wall of the rear propeller hub is tapered.

15. The propeller assembly of claim 14 wherein the forward propeller hub wall of the forward propeller hub has a fore hub end with a forward hub fore end diameter and an aft hub end with a forward hub aft end diameter, and a difference in diameter between the forward hub fore end diameter and the forward hub aft end diameter is 50%; and wherein the rear propeller hub wall of the rear propeller hub has a fore hub end with a rear hub fore end diameter and an aft hub end with a rear hub aft end diameter, and a difference in diameter between the rear hub fore end diameter and the rear hub aft end diameter is 50%.

16. The propeller assembly of claim 12 comprising a forward prop hub flare extending outwardly from the forward propeller hub wall of the forward propeller hub and a rear prop hub flare extending outwardly from the rear propeller hub wall of the rear propeller hub.

17. The propeller assembly of claim 12 wherein the rear prop hub diameter of the rear propeller is 20%-50% less than the forward prop hub diameter of the forward propeller.

18. The propeller assembly of claim 12 wherein each of the forward propeller hub wall of the forward propeller hub and the rear propeller hub wall of the rear propeller hub has a fore hub end and an aft hub end, and the at least one forward propeller service aperture is located at a selected point or position in an aft 50% along the length of the forward propeller hub and the at least one rear propeller service aperture is located at a selected point or position in an aft 50% along the length of the rear propeller hub.

19. The propeller assembly of claim 12 wherein the forward propeller lock tab removably and threadably engages the at least one forward propeller service aperture, and the rear propeller lock tab removably and threadably engages the at least one rear propeller service aperture.

20. A propeller assembly comprising:

a propeller drive assembly including a main propeller drive shaft, an outer propeller drive shaft drivingly engaged for rotation by the main propeller drive shaft in a first rotational direction, and an inner propeller drive shaft disposed in the outer propeller drive shaft and drivingly engaged for rotation by the main propeller drive shaft in a second rotational direction;

a forward propeller including:

a forward propeller hub including a forward propeller hub wall having a forward prop hub outer diameter;

a forward propeller hub bore formed by the forward propeller hub wall;

a forward propeller drive adaptor in the forward propeller hub bore, the forward propeller drive adaptor configured for driving engagement for rotation by the outer propeller drive shaft;

a front prop nut securing the forward propeller on the outer propeller drive shaft of the propeller drive assembly;

a forward hub drive sleeve in the forward propeller hub bore and drivingly engaged for rotation by the forward propeller drive adaptor, the forward hub drive sleeve drivingly engaging the forward propeller hub for rotation, the front prop nut threaded on the outer propeller drive shaft and configured to secure the forward propeller drive adaptor on the outer propeller drive shaft;

a plurality of forward propeller blades extending from the forward propeller hub wall;

at least one forward propeller service aperture extending radially through the forward propeller hub wall in communication with the forward propeller hub bore of the forward propeller, the at least one forward propeller service aperture configured for substantial radial alignment or registration with the front prop nut in driving engagement between the propeller drive assembly and the propeller assembly;

a forward propeller lock tab disposed in the at least one forward propeller service aperture of the forward propeller, the forward propeller lock tab configured for selective radial positional adjustment within the at least one forward propeller service aperture and the forward propeller hub bore for radial engagement and disengagement of the forward propeller lock tab with respect to the front prop nut; and a rear propeller including:

a rear propeller hub including a rear propeller hub wall having a rear prop hub outer diameter;

a rear propeller hub bore formed by the rear propeller hub wall;

a rear propeller drive adaptor in the rear propeller hub bore, the rear propeller drive adaptor configured for driving engagement for rotation by the inner propeller drive shaft;

a rear prop nut securing the rear propeller on the inner propeller drive shaft of the propeller drive assembly;

a rear hub drive sleeve in the rear propeller hub bore and drivingly engaged for rotation by the rear propeller drive adaptor, the rear hub drive sleeve drivingly engaging the rear propeller hub for rotation, the rear prop nut threaded on the inner propeller drive shaft and configured to secure the rear propeller drive adaptor on the inner propeller drive shaft; and a plurality of rear propeller blades extending from the rear propeller hub wall;

at least one rear propeller service aperture extending radially through the rear propeller hub wall in communication with the rear propeller hub bore of the rear propeller, the at least one rear propeller service aperture configured for substantial radial alignment or registration with the rear prop nut in driving engagement between the propeller drive assembly and the propeller assembly;

a rear propeller lock tab disposed in the at least one rear propeller service aperture of the rear propeller, the rear propeller lock tab configured for selective radial positional adjustment within the at least one rear propeller service aperture and the rear propeller hub bore for radial engagement and disengagement of the rear propeller lock tab with respect to the rear prop nut; and wherein the rear prop hub outer diameter of the rear propeller is less than the forward prop hub outer diameter of the forward propeller.

21. An apertured propeller method, comprising:

obtaining a propeller assembly having at least one propeller, the at least one propeller including a propeller hub having a propeller hub wall, a propeller hub bore formed by the propeller hub wall and a plurality of propeller blades extending from the propeller hub wall, the propeller assembly configured for driving engagement by a propeller drive assembly having at least one propeller drive shaft and at least one prop nut configured to secure the propeller assembly on the at least one propeller drive shaft;

providing at least one radial propeller service aperture in the propeller hub wall of the propeller in communication with the propeller hub bore;

providing the at least one propeller drive shaft of the propeller drive assembly in driving engagement with the propeller hub of the at least one propeller;

positioning the at least one radial propeller service aperture in substantial radial alignment or registration with the at least one prop nut;

deploying a propeller lock tab in the at least one propeller service aperture; and moving the propeller lock tab into engagement with the at least one prop nut.

22. The apertured propeller method of claim 21 comprising deploying a propeller aperture plug in the at least one propeller service aperture.

23. The apertured propeller method of claim 21 comprising assembling an exhaust flare ring on the at least one propeller by extending at least one fastener through the exhaust flare ring and the at least one propeller service aperture.

24. A propeller assembly configured for driving engagement by a propeller drive assembly having an inner propeller drive shaft, an outer propeller drive shaft, at least one rear prop nut configured to secure the propeller assembly on the inner propeller drive shaft and at least one front prop nut configured to secure the propeller assembly on the outer propeller drive shaft, the propeller assembly comprising:

a forward propeller including:

a forward propeller hub including a forward propeller hub wall having a fore hub end, an aft hub end and a forward prop hub outer diameter;

a single forward propeller hub bore formed by the forward propeller hub wall, the forward propeller hub bore extending through the forward propeller hub from the fore hub end to the aft hub end of the forward propeller hub;

the forward propeller hub bore forming a single flow path for motor exhaust from the fore hub end to the aft hub end of the forward propeller hub;

a plurality of forward propeller blades extending from the forward propeller hub wall;

at least one forward propeller service aperture extending radially through the forward propeller hub wall in communication with the forward propeller hub bore of the forward propeller, the at least one forward propeller service aperture configured for substantial radial alignment or registration with the at least one front prop nut; and a forward propeller lock tab disposed in the at least one forward propeller service aperture of the forward propeller, the forward propeller lock tab configured for selective radial positional adjustment within the at least one forward propeller service aperture and the forward propeller hub bore for radial engagement and disengagement of the forward propeller lock tab with respect to the at least one front prop nut;

a rear propeller including:

a rear propeller hub including a rear propeller hub wall having a fore hub end, an aft hub end and a rear prop hub outer diameter;

a rear propeller hub bore formed by the rear propeller hub wall, the rear propeller hub bore extending through the rear propeller hub from the fore hub end to the aft hub end of the rear propeller hub;

a plurality of rear propeller blades extending from the rear propeller hub wall;

at least one rear propeller service aperture extending radially through the rear propeller hub wall in communication with the rear propeller hub bore of the rear propeller, the at least one rear propeller service aperture configured for substantial radial alignment or registration with the at least one rear prop nut; and a rear propeller lock tab disposed in the at least one rear propeller service aperture of the rear propeller, the rear propeller lock tab configured for selective radial positional adjustment within the at least one rear propeller service aperture and the rear propeller hub bore for radial engagement and disengagement of the rear propeller lock tab with respect to the at least one rear prop nut; and wherein the rear prop hub outer diameter of the rear propeller is less than the forward prop hub outer diameter of the forward propeller.

* * * * *